US009348244B1

(12) United States Patent
Kiyono et al.

(10) Patent No.: US 9,348,244 B1
(45) Date of Patent: May 24, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Fusako Kiyono, Kanagawa (JP); Shintaro Anno, Kanagawa (JP); Hiroki Omori, Kanagawa (JP); Emi Matsushita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/833,818

(22) Filed: Aug. 24, 2015

(30) Foreign Application Priority Data

Mar. 2, 2015 (JP) ..... 2015-040602

(51) Int. Cl.
*G03G 15/08* (2006.01)
*G03G 9/08* (2006.01)

(52) U.S. Cl.
CPC ..... *G03G 9/0804* (2013.01); *G03G 15/08* (2013.01)

(58) Field of Classification Search
CPC ..... G03G 15/08; G03G 9/0804
See application file for complete search history.

(56) References Cited

U.S. PATENT DOCUMENTS

| | | | | |
|---|---|---|---|---|
| 7,459,255 | B2 * | 12/2008 | Tanaka | G03G 9/0804 430/110.3 |
| 7,759,038 | B2 * | 7/2010 | Yamazaki | G03G 9/0819 399/286 |
| 8,107,863 | B2 | 1/2012 | Yamazaki et al. | |
| 8,974,999 | B1 * | 3/2015 | Morales-Tirado | G03G 9/0819 399/252 |

FOREIGN PATENT DOCUMENTS

| | | | |
|---|---|---|---|
| JP | H05-323653 | A | 12/1993 |
| JP | H08-202075 | A | 8/1996 |
| JP | 5003433 | B2 | 8/2012 |
| JP | 2014-115476 | A | 6/2014 |

* cited by examiner

*Primary Examiner* — Gregory H Curran
(74) *Attorney, Agent, or Firm* — Oliff PLC

(57) ABSTRACT

An electrostatic charge image developing toner includes toner particles, elastomer particles which are externally added to the toner particles and contain a first oil, and inorganic particles which are externally added to the toner particles and contain a second oil having a viscosity higher than a viscosity of the first oil at 25° C.

11 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-040602 filed Mar. 2, 2015.

BACKGROUND

1. Technical Field

The present invention relates to electrostatic charge image developing toner, an electrostatic charge image developer, and a toner cartridge.

2. Related Art

A method of visualizing image information through an electrostatic charge image, such as electrophotography, is currently used in various fields. In electrophotography, an electrostatic charge image formed on a photoreceptor through a charging process and an electrostatic charge image forming process is developed using a developer containing a toner and is visualized through a transfer process and a fixing process.

SUMMARY

According to an aspect of the invention, there is provided an electrostatic charge image developing toner including:

toner particles;

elastomer particles which are externally added to the toner particles and contain a first oil; and inorganic particles which are externally added to the toner particles and contain a second oil having a viscosity higher than a viscosity of the first oil at 25° C.

BRIEF DESCRIPTION OF THE DRAWINGS

Exemplary embodiments of the present invention will be described in detail based on the following figures, wherein.

DETAILED DESCRIPTION

Figure 1:
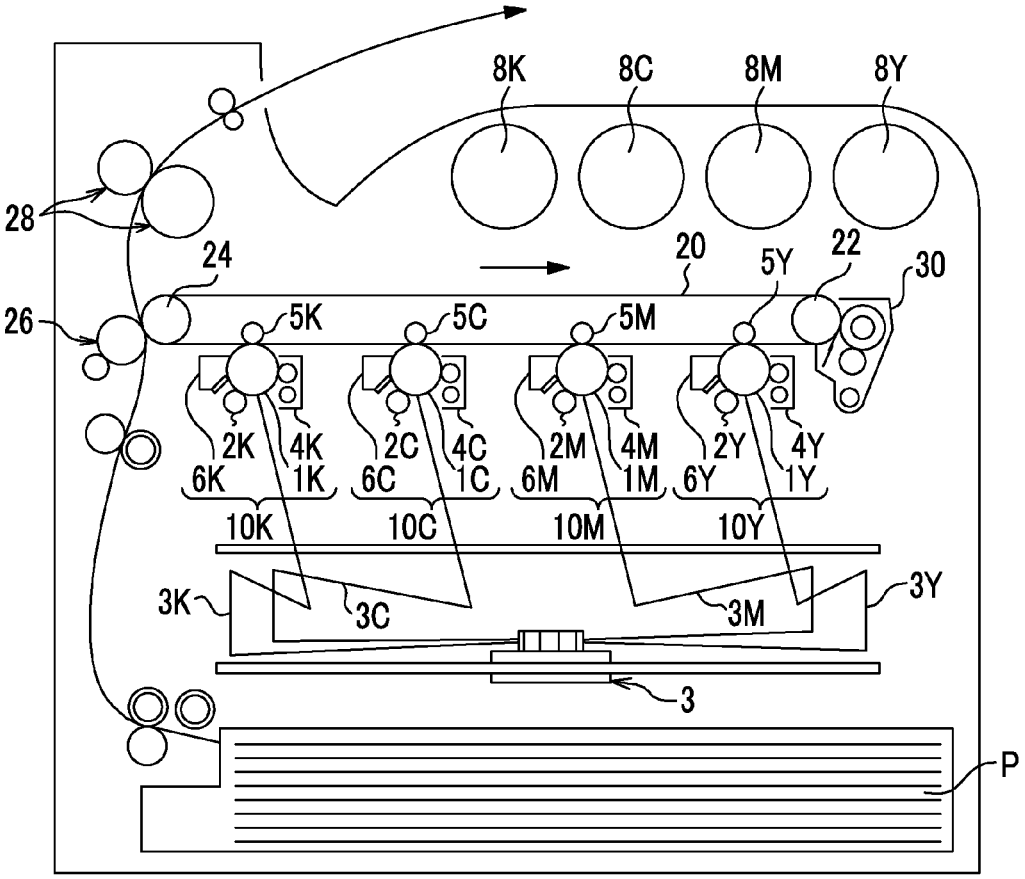
FIG. 1 is a schematic configuration diagram showing an example of an image forming apparatus according to the exemplary embodiment.

Hereinafter, the exemplary embodiments which are examples of the invention will be described in detail.

Electrostatic Charge Image Developing Toner

An electrostatic charge image developing toner according to the exemplary embodiment (hereinafter, may be referred to as a "toner") includes toner particles, elastomer particles which are externally added to the toner particles and contain a first oil, and inorganic particles which are externally added to the toner particles and contain a second oil having higher viscosity at 25° C. than that of the first oil.

According to the exemplary embodiment, excellent transfer efficiency is obtained and formation of color unevenness is prevented.

Reasons for such effects are not clear but assumed as follows.

The inorganic particles hold the containing second oil on the surface. It is considered that, since the inorganic particles externally added to the surface of each toner particle contain oil having higher viscosity as the second oil, the second oil held in the surface of each inorganic particle is also applied to the surface of each toner particle, and adhesiveness between the toner particles is improved. It is assumed that, by improving the adhesiveness between the toner particles, a phenomenon of formation of cracks between the toner particles is prevented in a toner image which is formed on an image holding member and transferred onto a recording medium, and as a result, an image in which formation of color unevenness is prevented, is obtained.

However, as described above, even when the adhesiveness between the toner particles is improved, release properties of the formed toner image from a member such as the image holding member are decreased and transfer properties are deteriorated, if only the adhesiveness between the toner particles is simply increased. With respect to this, in the exemplary embodiment, the elastomer particles contain oil having lower viscosity than as the first oil. It is considered that the elastomer particles hold the containing first oil therein, and the first oil seeps out from the elastomer particles due to pressure from a regulating member (trimmer) of a development device, when a toner image is formed on the surface of the image holding member from the development device. Therefore, it is considered that the first oil having lower viscosity is applied to the periphery of a toner image which is formed with the toner particles having adhesiveness that is increased by the second oil as described above, and as a result, it is assumed that the release properties between the toner image and a member such as the image holding member are obtained and excellent transfer properties are realized.

Hereinafter, the toner according to the exemplary embodiment will be described in detail.

The toner according to the exemplary embodiment contains the toner particles, and the inorganic particles and the elastomer particles which are externally added to the toner particles.

Elastomer Particles

First Oil

The elastomer particles contain the first oil having viscosity at 25° C. which is lower than that of the second oil containing in the inorganic particles which will be described later.

Measurement of the viscosity of the first oil and the second oil is performed by separating each of the first oil and the second oil from the toner and measuring the viscosity at 25° C. using RS-CPS Plus manufactured by BROOKFIELD.

The viscosity of the first oil at 25° C. is preferably from 0.01 Pa·s to 0.5 Pa·s and more preferably from 0.03 Pa·s to 0.3 Pa·s.

By setting the viscosity to be equal to or smaller than the upper limit, the release properties between the toner image and a member such as the image holding member are excellently exhibited. Meanwhile, by setting the viscosity to be equal to or greater than the lower limit, stable oil seeping properties are exhibited with the pressure from a regulating member (trimmer) of a development device.

The first oil contained in the elastomer particles preferably have a melting point lower than 20° C. As the first oil contained in the elastomer particles, a compound having a melting point lower than 20° C., that is, a compound which is liquid at 20° C. is preferably used, and well-known various silicone oil or lubricant is exemplified. In addition, a boiling point of the first oil is preferably equal to or higher than 150° C. and more preferably equal to or higher than 200° C.

As the first oil, silicone oil is particularly preferable.

Examples of silicone oil include silicone oil such as dimethyl polysiloxane, diphenyl polysiloxane, and phenyl methyl polysiloxane, and reactive silicone oil such as amino-modified polysiloxane, epoxy-modified polysiloxane, carboxyl-modified polysiloxane, carbinol modified polysiloxane, fluorine-modified polysiloxane, methacryl-modified polysiloxane, mercapto-modified polysiloxane, and phenol modified polysiloxane. Among these, dimethyl polysiloxane (also referred to as "dimethyl silicone oil") is more preferable.

In addition, as the first oil, oil having a reverse polarity to the inorganic particles (external additive) which will be described later may be used. Examples of oil having a reverse polarity to the inorganic particles include oil having positive charging properties such as monoamine-modified silicone oils, diamine-modified silicone oil, amino-modified silicone oil, and ammonium modified silicone oil; and oil having negative charging properties such as dimethyl silicone oil, alkyl-modified silicone oil, α-methyl sulfone-modified silicone oil, chlorophenyl silicone oil, and fluorine-modified silicone oil.

In addition, as the first oil contained in the elastomer particles, oil which is the same type as the second oil contained in the inorganic particles and has different weight average molecular weight is preferably used. Specifically, as the same type of oil, oil in which 90 mol % or more of monomers as raw materials are the same is preferable, and a repeating unit included in a molecular chain, 90 mol % or more of which is the same, is preferable as a molecular structure of the oil.

By using the oil which is the same type as the second oil contained in the inorganic particles and has a great molecular weight, as the first oil contained in the elastomer particles, a configuration having higher viscosity at 25° C. is realized.

By using the same type of oil in the elastomer particles and the inorganic particles, excellent conformability of both oil items is obtained and more excellent transfer efficiency and a prevention effect of color unevenness are both satisfied.

The oil items which are the same type and have different molecular weights, also have different temperature dependability of viscosity, when a molecular weight is small, the viscosity at a higher temperature is easily deteriorated. In an image forming apparatus, a temperature is easily increased due to the driving of the apparatus and may reach a temperature equal to or higher than 50° C. In the image forming apparatus at such a high temperature, the oil having a smaller molecular weight, that is, the first oil contained in the elastomer particles has a strong tendency to have lower viscosity. Accordingly, it is considered that excellent adhesiveness between the toner particles is maintained and release properties between the toner image and a member such as the image holding member are further increased. As a result, more excellent transfer efficiency is obtained.

A weight-average molecular weight of the first oil is preferably from 1,000 to 20,000 and more preferably from 2,000 to 10,000.

The weight-average molecular weight of the first oil and the second oil is measured and calculated by gel permeation chromatography (GPC). Specifically, the measurement of a resin by GPC is performed with a tetrahydrofuran (THF) solvent using HLC-8120 manufactured by Tosoh Corporation by using a column TSKgel Super HM-M (15 cm) manufactured by Tosoh Corporation. Next, the molecular weight of the oil is calculated using a calibration curve of molecular weight created with a monodisperse polystyrene standard sample.

The first oil contained in the elastomer particles may be one kind or may be two or more kinds.

The total content of the first oil in the elastomer particles is preferably from 0.01 mg to 100 mg, more preferably from 0.05 mg to 50 mg, and even more preferably from 0.1 mg to 30 mg, with respect to 1 g of the toner.

As a method of measuring the total content of the first oil in the elastomer particles of the toner, after repeating an operation of performing ultrasonic cleaning of the elastomer particles in hexane (at output of 60 W and a frequency of 20 kHz for 30 minutes) and filtering the cleaning solution to remove the first oil, five times, vacuum drying is performed at 60° C. for 12 hours. The content of the first oil in the elastomer particles is calculated from a change in the weights thereof before and after removing the first oil and the total content of the first oil with respect to the 1 g of the toner is calculated from the amount of the elastomer particles added to the toner.

Elastomer Particles

In order to cause the elastomer particles to contain the first oil, the elastomer particles are preferably porous particles having a plurality of holes at least on the surface of each particle, and a specific surface area of the elastomer particles is preferably from 0.1 $m^2/g$ to 25 $m^2/g$, more preferably from 0.3 $m^2/g$ to 20 $m^2/g$, and even more preferably from 0.5 $m^2/g$ to 15 $m^2/g$. When the specific surface area thereof is in the range described above, the elastomer particles easily contain (is easily impregnated with) the first oil.

A method of measuring the specific surface area of the elastomer particles is performed using a BET method.

Specifically, precise weighing of 0.1 g of a measurement sample is performed, put in a sample tube, and subjected to degassing, and the specific surface area is obtained by automatic measurement of a multipoint method, using the elastomer particles separated from the toner and a specific surface area and pores distribution measurement device (SA3100 manufactured by Beckman Coulter, Inc.)

The material of the elastomer particles is not particularly limited, as long as it is a material having a property of being deformed due to an external force and being recovered from the deformation, when there is no external force, which is a so-called elastomer, and various well-known elastomers are exemplified. Specific examples thereof include synthetic rubber such as urethane rubber, silicone rubber, fluorine rubber, chloroprene rubber, butadiene rubber, ethylene-propylene-diene copolymer rubber (EPDM), and epichlorohydrin rubber, and a synthetic resin such as polyolefin, polystyrene, and polyvinyl chloride.

Among these, a styrene resin is preferable and a copolymer of styrene and a cross-linking agent is more preferable, in order to easily prepare the elastomer particles by emulsion polymerization.

A number average particle diameter of the elastomer particles is preferably from 1 μm to 30 μm, more preferably from 3 μm to 20 μm, and even more preferably from 5 μm to 20 μm.

By setting the number average particle diameter of the elastomer particles to be equal to or greater than 1 μm, the elastomer particles are rarely attached to the toner particles and fluidity of the toner is hardly deteriorated. In addition, in the development device, pressure from the regulating member (trimmer) is easily received. By setting the number average particle diameter of the elastomer particles to be equal to or smaller than 30 μm, the first oil easily seeps out and the release properties thereof from a member such as the image holding member are increased.

A volume average particle diameter ($D50_{VE}$) of the elastomer particles and a volume average particle diameter ($D50_{VT}$) of the toner particles preferably satisfy a relationship of the following expression (1).

$$0.8 \leq D50_{VE}/D50_{VT} \leq 2 \quad \text{Expression (1):}$$

By setting $D50_{VE}/D50_{VT}$ to be equal to or greater than 0.8, the elastomer particles are rarely attached to the toner particles and fluidity of the toner is hardly deteriorated. In addition, in the development device, pressure from the regulating member (trimmer) is easily received. By setting $D50_{VE}/D50_{VT}$ to be equal to or smaller than 2, the first oil easily seeps out and the release properties thereof from a member such as the image holding member are increased.

The value of $D50_{VE}/D50_{VT}$ shown in the expression (1) is preferably in a range of 0.9 to 1.8 and more preferably in a range of 1.0 to 1.5.

Regarding the number average particle diameter and the volume average particle diameter of the elastomer particles in the toner, 100 primary particles are observed with a scanning electron microscope (SEM) (S-4100 manufactured by Hitachi, Ltd.) and image thereof is captured, this image is put in an image analyzer (LUZEX III manufactured by Nireco Corporation), and a number average particle diameter and a volume average particle diameter of the equivalent circle diameters obtained by the image analysis of the primary particles are calculated. The magnification of the electron microscope is adjusted so that approximately 10 to 50 elastomer particles are shown in 1 visual filed and the equivalent circle diameters of the primary particles are determined in combination of observation in plural visual fields.

The content of the elastomer particles is preferably from 0.05 parts by weight to 5 parts by weight, more preferably from 0.1 parts by weight to 3 parts by weight, and even more preferably from 0.1 parts by weight to 2 parts by weight, with respect to 100 parts by weight of the toner particles.

Method of Preparing Elastomer Particles

A method of preparing the elastomer particles is not particularly limited, and a well-known method may be used, and examples thereof include a method of processing elastomer materials into a particular shape, and a method of mixing a pore forming agent with an emulsified particle, performing emulsification polymerization and removing the pore forming agent, in a case of preparing the elastomer by emulsification polymerization. Among these, the method of mixing a pore forming agent with an emulsified particle, performing emulsification polymerization and removing the pore forming agent, in a case of preparing the elastomer by emulsification polymerization is preferably used, in order to easily prepare spherical particles.

As the pore forming agent, a compound which is solid at the time of emulsification polymerization and is removed by at least one of dissolving and decomposing after the emulsification polymerization, or a diluent which does not contribute to a polymerization reaction at the time of emulsification polymerization is exemplified.

As the compound which is solid at the time of emulsification polymerization and is removed by at least one of dissolving and decomposing after the emulsification polymerization, calcium carbonate is preferable, in viewpoint of cost and availability. Calcium carbonate has low solubility to water, and dissolves while emitting carbon dioxide, when it contact with an acidic solution.

The diluent is not particularly limited, and diethylbenzene, isoamyl alcohol, and the like are preferably used.

An amount of diluent used is preferably greater than an amount of a polymerizable compound used.

The shape of the pore forming agent is preferably a particular shape, and a number average particle diameter of the pore forming agent is preferably from 5 nm to 200 nm and more preferably from 5 nm to 100 nm.

In addition, conditions of the emulsification polymerization are not particularly limited, and the emulsification polymerization may be performed under conditions of well-known emulsification polymerization, except for using the pore forming agent, for example.

Method of Causing Elastomer Particles to Contain First Oil

A method of causing the elastomer particles to contain the first oil is not particularly limited, and a method of bringing the elastomer particles and the first oil to contact with each other, a method of dissolving the first oil in an organic solvent, bringing the solution to contact with the elastomer particles, and removing the organic solvent, and the like are preferably used, for example.

The contacting may be performed in a well-known method, and a method of mixing the elastomer particles and the first oil or a solution of the first oil with each other, or a method of dipping the elastomer particles in the first oil or a solution of the first oil is preferably used, for example.

The organic solvent is not particularly limited, as long as it dissolves the first oil having a reverse polarity to the inorganic particles, and a hydrocarbon solvent or alcohols are preferably used, for example.

Inorganic Particles

Second Oil

The inorganic particles contain the second oil having viscosity at 25° C. which is higher than that of the first oil contained in the elastomer particles described above.

The viscosity of the second oil at 25° C. is preferably from 0.03 Pa·s to 1 Pa·s, more preferably from 0.05 Pa·s to 0.8 Pa·s, and even more preferably from 0.1 Pa·s to 0.5 Pa·s.

By setting the viscosity to be equal to or greater than the lower limit, adhesiveness between the toner particles is excellently exhibited. Meanwhile, by setting the viscosity to be equal to or smaller than the upper limit, it is possible to process the inorganic particles to be substantially in a uniform state and excellent fluidity is obtained.

The second oil contained in the inorganic particles preferably have a melting point lower than 20° C. As the second oil contained in the inorganic particles, a compound having a melting point lower than 20° C., that is, a compound which is liquid at 20° C. is preferably used, and well-known various silicone oil or lubricant is exemplified. In addition, a boiling point of the second oil is preferably equal to or higher than 150° C. and more preferably equal to or higher than 200° C.

As the second oil, silicone oil is particularly preferable.

Examples of silicone oil include silicone oil such as dimethyl polysiloxane, diphenyl polysiloxane, and phenyl methyl polysiloxane, and reactive silicone oil such as amino-modified polysiloxane, epoxy-modified polysiloxane, carboxyl-modified polysiloxane, carbinol modified polysiloxane, fluorine-modified polysiloxane, methacryl-modified polysiloxane, mercapto-modified polysiloxane, and phenol modified polysiloxane. Among these, dimethyl polysiloxane (also referred to as "dimethyl silicone oil") is more preferable.

In addition, examples of the second oil may include oil having positive charging properties such as monoamine-modified silicone oils, diamine-modified silicone oil, amino-modified silicone oil, and ammonium modified silicone oil; and oil having negative charging properties such as dimethyl silicone oil, alkyl-modified silicone oil, α-methyl sulfone-modified silicone oil, chlorophenyl silicone oil, and fluorine-modified silicone oil.

In addition, as the second oil contained in the inorganic particles, oil which is the same type as the first oil contained in the elastomer particles and has different weight average molecular weight is preferably used.

A weight-average molecular weight of the second oil is preferably from 2,000 to 30,000, more preferably from 3,000 to 25,000, and even more preferably from 6,000 to 20,000.

The second oil contained in the inorganic particles may be one kind or may be two or more kinds.

The total content of the second oil in the inorganic particles is preferably from 0.1 mg to 20 mg, more preferably from 1 mg to 10 mg, and even more preferably from 1 mg to 5 mg, with respect to 1 g of the toner.

As a method of measuring the total content of the second oil in the inorganic particles of the toner, after repeating an operation of performing ultrasonic cleaning of the inorganic particles in hexane (at output of 60 W and a frequency of 20 kHz for 30 minutes) and filtering the cleaning solution to remove the second oil, five times, vacuum drying is performed at 60° C. for 12 hours. The content of the second oil in the inorganic particles is calculated from a change in the weights thereof before and after removing the second oil and the total content of the second oil with respect to the 1 g of the toner is calculated from the amount of the inorganic particles added to the toner.

A method of causing the inorganic particles to contain the second oil is performed, for example, by dipping the inorganic particles in the second oil. The amount of the second oil is generally preferably from 1 parts by weight to 20 parts by weight with respect to 100 parts by weight of the inorganic particles, for example.

Inorganic Particles

A number average particle diameter of the inorganic particles is preferably from 10 nm to 200 nm.

As the inorganic particles, a small particle diameter external additive having a number average particle diameter of 10 nm to 30 nm and a large particle diameter external additive having a number average particle diameter exceeding 30 nm and equal to or smaller than 200 nm may be used in combination.

The combination use of the small particle diameter external additive and the large particle diameter external additive as the inorganic particles is preferable, in order ensure toner fluidity and to minimize a change in toner fluidity with respect to a stirring stress received in the development device.

The number average particle diameter of the small particle diameter external additive is more preferably in a range of 15 nm to 20 nm.

The number average particle diameter of the large particle diameter external additive is more preferably in a range of 40 nm to 150 nm.

When the small particle diameter external additive and the large particle diameter external additive are used in combination, the second oil may be contained in both or any one of the external additives. Herein, it is preferable to cause only the small particle diameter external additive to contain the second oil, because adhesiveness may be exhibited only at the time of aggregation.

In a case of using the inorganic particles separated from the toner, the number average particle diameter of the inorganic particles is measured using a Coulter Multisizer II (manufactured by Beckman Coulter, Inc.)

When the toner is directly observed, 100 primary particles are observed with a scanning electron microscope (SEM) (S-4100 manufactured by Hitachi, Ltd.) and image thereof is captured, this image is put in an image analyzer (LUZEX III manufactured by Nireco Corporation), and a number average particle diameter of the equivalent circle diameters obtained by the image analysis of the primary particles is calculated. The magnification of the electron microscope is adjusted so that approximately 10 to 50 inorganic particles are shown in 1 visual filed and the equivalent circle diameters of the primary particles are determined in combination of observation in plural visual fields.

Examples of the material of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, silica particles are preferable. Examples of silica particles include silica particles such as fumed silica, colloidal silica, and silica gel, and these are used without particular limitation. The silica particles may be used alone or in combination of two or more kinds.

As the small particle diameter external additive in a case of using the small particle diameter external additive and the large particle diameter external additive in combination, $SiO_2$, $TiO_2$, and $Al_2O_3$ are preferable among the materials exemplified above.

As the large particle diameter external additive, $SiO_2$ and $Al_2O_3$ are preferable among the materials exemplified above.

In a case of using the small particle diameter external additive and the large particle diameter external additive in combination and using these without causing any one of particles to not contain the second oil, surface treatment (hydrophobizing treatment) may be executed. As the surface treatment, for example, surface treatment using a coupling agent (for example, a silane coupling agent or a titanate coupling agent), fatty acid metal salt, or a charge-controlling agent is exemplified.

The amount of the inorganic particles externally added is, for example, preferably from 0.01% by weight to 5% by weight, and more preferably from 0.01% by weight to 3.0% by weight with respect to the toner particles.

In a case of using the small particle diameter external additive and the large particle diameter external additive in combination, the content of the small particle diameter external additive is preferably from 0.01% by weight to 5% by weight and more preferably from 0.1% by weight to 2.0% by weight. Meanwhile, the content of the large particle diameter external additive is preferably from 0.1% by weight to 5% by weight and more preferably from 1.0% by weight to 3.0% by weight.

Toner Particles

The toner particles, for example, contain a binder resin, and if necessary, a colorant, a release agent, and other external additives.

Binder Resin

Examples of the binder resins include a homopolymer consisting of monomers such as styrenes (for example, styrene, p-chlorostyrene, α-methyl styrene, or the like), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

As the binder resin, a polyester resin is preferable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic dials and alicyclic dials are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K7121-1987 "Testing Methods for Transition Temperature of Plastics"

The weight-average molecular weight (Mw) of the amorphous polyester resin is preferably from 5,000 to 1,000,000, and more preferably from 7,000 to 500,000.

The number-average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using GPC·HLC-8120 GPC manufactured by Tosoh Corporation as a measurement device by using a column TSKgel Super HM-M (15 cm) manufactured by Tosoh Corporation. The weight-average molecular weight and the number-average molecular weight are calculated using a calibration curve of molecular weight created with a monodisperse polystyrene standard sample from results of this measurement.

A known preparing method is applied to prepare the amorphous polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The total content of the binder resin is, for example, preferably from 40% by weight to 95% by weight, more preferably from 50% by weight to 90% by weight, and even more preferably from 60% by weight to 85% by weight with respect to the entirety of the toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Release Agent

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K7121-1987 "Testing Methods for Transition Temperatures of Plastics", from a DSC curve obtained by differential scanning calorimetry (DSC).

The content of the release agent is, for example, preferably from 1% by weight to 20% by weight, and more preferably from 5% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin, and if necessary, other additives such as a colorant and a release agent and a coating layer containing a binder resin.

The volume average particle diameter ($D50_{VT}$) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number-average particle diameter D16p, while the particle diameter when the cumulative percentage becomes 50% is defined as that corresponding to a volume average particle diameter D50v and a number-average particle diameter D50p. Furthermore, the particle diameter when the cumulative percentage becomes 84% is defined as that corresponding to a volume average particle diameter D84v and a number-average particle diameter D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $SF1=(ML^2/A)\times(\pi/4)\times100$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the respective processes will be described in detail.

In the following description, a method of obtaining toner particles containing a colorant and a release agent will be described, but the colorant and the release agent are only used if necessary. Additives other than the colorant and the release agent may also be used.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding inorganic particles to dry toner particles that have been obtained, and further adding elastomer particles thereto, followed by mixing. The mixing is preferably performed with, for example, a V-blender, a Henschel mixer, a Lodige mixer, or the like. Furthermore, if necessary, coarse toner particles may be removed using a vibration sieving machine, a wind-power sieving machine, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluidized bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to this exemplary embodiment as a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). Furthermore, when the yellow toner is held on the developer roll, a pressure is applied to the yellow toner by a regulating material (trimmer/not shown) provided in the developing device 4Y to regulate the thickness, thereby obtaining the desired thickness. By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer as a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
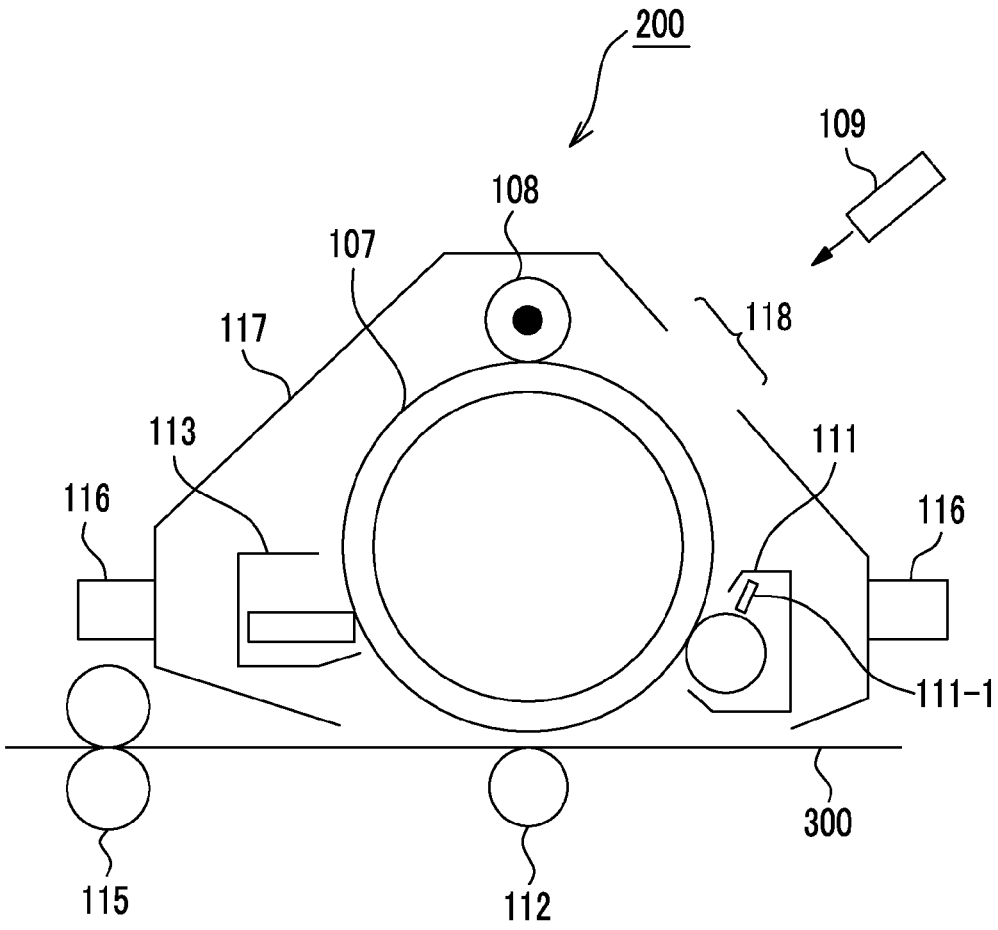
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium). Furthermore, 111-1 represents a regulating material (trimmer) provided in the developing device 111. When the toner is held on the developer roll, a pressure is applied to the toner by the regulating material 111-1 to regulate the thickness, thereby providing the desired thickness.

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be described in detail using examples and comparative examples, but is not limited to these examples. Unless specifically noted, "parts" and "%" means "parts by weight" and "% by weight".

Example 1

Preparation of Elastomer Particles 100 parts of methylvinyl polysiloxane and 10 parts of methylhydrogen siloxane are mixed with each other, 30 parts of calcium carbonate powder (number average particle diameter of 0.1 μm, TP-123 manufactured by Okutama Kogyo CO., LTD.), 1 part of polyoxyethylene octylphenyl ether, and 200 parts of water are added to the mixture, the mixture is emulsified using a mixer at 6,000 rpm for 3 minutes, 0.001 part of chloroplatinic acid-olefin complex salt is added thereto as an amount of platinum, and polymerization reaction is conducted under a nitrogen atmosphere at 80° C. for 10 hours. After that, hydrochloric acid is added to decompose calcium carbonate, and then water washing is performed. In addition, wet classification is performed to select elastomer particles having a desired volume average particle diameter ($D50_{VE}$), and vacuum drying is conducted at 100° C. for 12 hours.

After that, 150 parts of dimethyl silicone oil (PDMS, viscosity $\mu_{VE}$ (25° C.) 0.05 Pa·s) is dissolved in 1000 parts of ethanol, 100 parts of the elastomer particles are stirred therewith and mixed thereto, ethanol being the solvent is distilled away using an evaporator and dry is performed, to thereby obtain elastomer particles treated with oil.

Preparation of Crystalline Polyester Resin Dispersion 45 parts by mol of 1,9-nonanediol, 55 parts by mol of dodecanedicarboxylic acid, and 0.05 parts by mol of dibutyl tin oxide as a catalyst are added in a heated and dried three-necked flask, air in the vessel is turned into an inert atmosphere with nitrogen gas by performing pressure reducing operation, the mixture is stirred and refluxed by mechanical stirring at 180° C. for 2 hours. After that, the temperature is slowly increased to 230° C. under the reduced pressure, the mixture is stirred for 5 hours and cooled and, when a viscous state is obtained, the reaction is stopped and thus a crystalline polyester resin is synthesized. The weight average molecular weight (Mw) of the obtained crystalline polyester resin is measured by gel permeation chromatography (polyester conversion), it is 25,000. Then, 3,000 parts of the obtained crystalline polyester resin, 10,000 parts of ion exchange water, and 90 parts of sodium dodecylbenzenesulfonate as a surfactant are added into a emulsification tank of a high temperature and high pressure emulsification device (Cavitron CD1010 manufactured by Eurotec Co., Ltd., slit: 0.4 mm), heated and melted at 130° C., dispersed at 110° C., a flow rate of 3 L/m, and 10,000 rotations for 30 minutes, and is caused to pass a cooling tank to collect a crystalline polyester resin dispersion (high temperature and high pressure emulsification device, and the crystalline polyester resin dispersion is obtained.

Preparation of Amorphous Polyester Resin Dispersion 15 parts by mol of polyoxyethylene (2,0)-2,2-bis(4-hydroxyphenyl) propane, 85 parts by mol of polyoxypropylene (2,2)-2,2-bis(4-hydroxyphenyl) propane, 10 parts by mol of terephthalic acid, 67 parts by mol of fumaric acid, 3 parts by mol of n-dodecenylsuccinic acid, 20 parts by mol of trimellitic acid, and dibutyl tin oxide, the amount of which is 0.05 parts by mol with respect to the above acid components (total mole number of terephthalic acid, fumaric acid, n-dodecenylsuccinic acid, and trimellitic acid) are put into a vessel, nitrogen gas is introduced into the vessel to maintain the air in an inert atmosphere and to increase the temperature, and copolycondensation is performed at 150° C. to 230° C. for 12 hours to 20 hours. After that, the pressure is slowly reduced at 210° C. to 250° C., and the amorphous polyester resin is synthesized. The weight average molecular weight Mw of the resin is 65,000. Then, 3,000 parts of the obtained amorphous polyester resin, 10,000 parts of ion exchange water, and 90 parts of sodium dodecylbenzenesulfonate as a surfactant are added into a emulsification tank of a high temperature and high pressure emulsification device (Cavitron CD1010 manufactured by Eurotec Co., Ltd., slit: 0.4 mm), heated and melted at 130° C., dispersed at 110° C., a flow rate of 3 L/m, and 10,000 rotations for 30 minutes, and is caused to pass a cooling tank to collect a amorphous polyester resin dispersion (high temperature and high pressure emulsification device, and the amorphous polyester resin dispersion is obtained.

Preparation of Cyan Colorant Dispersion

Cyan pigment (copper phthalocyanine, C.I. Pigment Blue 15:3 manufactured by Dainichiseika Color & Chemicals Mfg. Co., Ltd.): 1,000 parts Ionic surfactant NEOGEN RK (manufactured by Dai-Ichi Kogyo Seiyaku Co., Ltd.): 150 parts Ion exchange water: 4,000 parts The above materials are mixed, dissolved, and dispersed using a high-pressure impact type disperser ULTIMIZER (HJP30006 manufactured by SUGINO MACHINE LIMITED) for 1 hour, and thus a cyan colorant dispersion having a solid content of 20% is obtained. The volume average particle diameter of the pigment is 180 nm.

Preparation of Magenta Colorant Dispersion

Magenta pigment (C. I. Pigment Red 122: manufactured by Dainichiseika Color & Chemicals Mfg. Co., Ltd.): 1,000 parts Ionic surfactant NEOGEN RK (manufactured by Dai-Ichi Kogyo Seiyaku Co., Ltd.): 150 parts Ion exchange water: 4,000 parts The above materials are mixed, dissolved, and dispersed using a high-pressure impact type disperser ULTIMIZER (HJP30006 manufactured by SUGINO MACHINE LIMITED) for 1 hour, and thus a magenta colorant dispersion having a solid content of 20% is obtained. The volume average particle diameter of the pigment is 180 nm.

Preparation of Release Agent Dispersion

Paraffin Wax HNP9 (melting temperature of 75° C.: manufactured by Nippon Seiro Co., Ltd.): 46 parts Cationic surfactant NEOGEN RK (manufactured by Dainichiseika Color & Chemicals Mfg. Co., Ltd.): 5 parts Ion exchange water: 200 parts The above materials are heated to 100° C., sufficiently dispersed using Ultra Turrax T50 manufactured by IKA Japan K.K., and dispersed using a pressure discharge type Gaulin homogenizer, and thus a release agent dispersion having a solid content of 20.0% is obtained. The volume average particle diameter of the paraffin wax is 200 nm.

Preparation of Toner Particles

Amorphous polyester resin dispersion: 256.8 parts

Crystalline polyester resin dispersion: 33.2 parts

Colorant dispersion (any one of cyan colorant and magenta colorant): 27.4 parts

Release agent dispersion: 35 parts

The above materials are sufficiently mixed and dispersed in a round stainless steel flask using Ultra Turrax T50. Then, 0.20 parts of polyaluminum chloride is added thereto and the dispersion operation is continued using Ultra Turrax. The flask is heated to 48° C. while stirring in an oil bath for heating, and maintained at 48° C. for 60 minutes (aggregation process). Then, 70.0 parts of the amorphous polyester resin dispersion is added thereto. Then, after adjusting the pH in the system to 8.0 using sodium hydroxide aqueous solution having a concentration of 0.5 mol/L, the stainless steel flask is sealed, heated to 96° C. while continuing stirring using magnetic seal, and kept for 3 hours (coalescence process). After the reaction ends, the mixture is cooled, filtered, and sufficiently washed with ion exchange water, and solid-liquid separation is performed by Nutsche-type suction filtration. In addition, the solid content is dispersed again in 1,000 parts of ion exchange water at 30° C., stirred and washed at 300 rpm for 15 minutes. This operation is further repeated five times.

When the pH of the filtrate is 7.5 and electrical conductivity is 7.0 μS/cm, the solid-liquid separation is performed by Nutsche-type suction filtration using No. 5A filter paper. Next, vacuum drying is continued for 12 hours. When the particle diameter at that time is measured with a Coulter Multisizer II (manufactured by Beckman Coulter, Inc.), the volume average particle diameter thereof is 4.0 p.m.

Preparation of Inorganic Particles (Small Particle Diameter External Additive)

10 parts of dimethyl silicone oil (PDMS, viscosity $\mu_{VA}$ (25° C.) 0.1 Pa·s) is added to 100 parts of silica (AEROSIL (registered trademark) 200 manufactured by Nippon Aerosil co. ltd.) and further stirred for 15 minutes. Finally the temperature is increased to 90° C., ethanol is dried under the reduced pressure, a processed material is taken out, and vacuum drying is further performed at 120° C. for 30 minutes. The dried silica is pulverized to thereby obtain inorganic particles having a number average particle diameter of 15 nm.

Preparation of Toner 0.5 parts of the elastomer particles, 3.6 parts of the inorganic particles (small particle diameter external additive), 1.3 parts of the silica (AEROSIL (registered trademark) RX50, number average particle diameter of 80 nm, manufactured by Nippon Aerosil co. ltd.) as the large particle diameter external additive are mixed with 100 parts of the toner particles in a Henschel mixer at 3,600 rpm for 10 minutes, and thus a toner is prepared.

Preparation of Carrier

Ferrite particles (average particle diameter of 50 μm and volume electric resistance of $3\times10^8$ Ω·cm): 100 parts Toluene: 14 parts Perfluorooctyl ethyl acrylate/dimethyl amino ethyl methacrylate copolymer (copolymerization ratio of 90:10, Mw=50,000):1.6 parts Carbon black (VXC-72 manufactured by Cabot Corporation):0.12 parts Among the above components, the components excluding the ferrite particles are dispersed using a stirrer for 10 minutes, a coating film forming solution is prepared, this coating film forming solution and the ferrite particles are added in a vacuum degassing type kneader, stirred at 60° C. for 30 minutes, toluene is removed by reducing the pressure, the resin coating film is formed on the surface of the ferrite particles, and thus a carrier is prepared. A volume average particle diameter of the obtained carrier is 51 μm.

Preparation of Developer

The toner and the carrier prepared as described above are put in V-blender at a weight ratio of 5:95 and stirred for 20 minutes, and thus a developer is obtained.

The obtained developer is charged in DocuCentre Color 400 (manufactured by Fuji Xerox Co., Ltd.) and the following evaluation is performed.

Example 2

A developer is prepared in the same manner as in Example 1, except for changing the volume average particle diameter of the toner particles in Example 1 to the volume average particle diameter shown in Table 1.

The adjustment of the volume average particle diameter of the toner particles is performed by controlling the temperature and the time in the aggregation process and the temperature and the time in the coalescence process when preparing the toner particles described in Example 1.

Example 3

A developer is prepared in the same manner as in Example 2, except for changing the volume average particle diameter of the elastomer particles in Example 2 to the volume average particle diameter disclosed in Table 1.

The adjustment of the volume average particle diameter of the elastomer particles is performed by controlling the rotation rate of the mixer and the time at the time of the emulsification when preparing the elastomer particles described in Example 1. The same applies to the following examples.

Example 4

A developer is prepared in the same manner as in Example 1, except for changing the volume average particle diameter of the elastomer particles in Example 1 to the volume average particle diameter disclosed in Table 1.

Example 5

A developer is prepared in the same manner as in Example 1, except for changing the volume average particle diameter of the elastomer particles in Example 1 to the volume average particle diameter disclosed in Table 1.

Example 6

A developer is prepared in the same manner as in Example 1, except for changing the first oil contained in the elastomer particles in Example 1 to methylhydrogen polysiloxane (PhMS, viscosity $\mu_{VE}$ (25° C.) 0.05 Pa·s).

Example 7

A developer is prepared in the same manner as in Example 1, except for changing the first oil contained in the elastomer particles in Example 1 to amino-modified polysiloxane (PDMS-AN, viscosity $\mu_{VE}$ (25° C.) 0.05 Pa·s).

Example 8

A developer is prepared in the same manner as in Example 1, except for changing the weight average molecular weight and the viscosity $\mu_{VE}$ (Pa·s) of the first oil contained in the elastomer particles in Example 1 to those disclosed in Table 1.

Example 9

A developer is prepared in the same manner as in Example 1, except for changing the weight average molecular weight and the viscosity $\mu_{VE}$ (Pa·s) of the first oil contained in the elastomer particles in Example 1 to values disclosed in Table 1 and changing the weight average molecular weight and the viscosity $\mu_{VA}$ (Pa·s) of the second oil contained in the inorganic particles (small particle diameter external additive) to values disclosed in Table 1.

Example 10

A developer is prepared in the same manner as in Example 1, except for changing the weight average molecular weight and the viscosity $\mu_{VA}$ (Pa·s) of the second oil contained in the inorganic particles (small particle diameter external additive) in Example 1 to values disclosed in Table 1.

Example 11

A developer is prepared in the same manner as in Example 1, except for changing the weight average molecular weight and the viscosity $\mu_{VE}$ (Pa·s) of the first oil contained in the elastomer particles in Example 1 to values disclosed in Table 1 and changing the weight average molecular weight and the viscosity $\mu_{VA}$ (Pa·s) of the second oil contained in the inorganic particles (small particle diameter external additive) to values disclosed in Table 1.

Example 12

A developer is prepared in the same manner as in Example 1, except for changing the weight average molecular weight and the viscosity $\mu_{VE}$ (Pa·s) of the first oil contained in the elastomer particles in Example 1 to values disclosed in Table 1 and changing the weight average molecular weight and the viscosity $\mu_{VA}$ (Pa·s) of the second oil contained in the inorganic particles (small particle diameter external additive) to values disclosed in Table 1.

Example 13

A developer is prepared in the same manner as in Example 1, except for changing the weight average molecular weight and the viscosity $\mu_{VE}$ (Pa·s) of the first oil contained in the elastomer particles in Example 1 to values disclosed in Table 1 and changing the type of the second oil contained in the inorganic particles (small particle diameter external additive) to methylhydrogen polysiloxane (PhMS, viscosity $\mu_{VE}$ (25° C.) 0.05 Pa·s).

Comparative Example 1

A developer is prepared in the same manner as in Example 1, except for not incorporating the second oil into the inorganic particles (small particle diameter external additive).

Comparative Example 2

A developer is prepared in the same manner as in Example 1, except for not incorporating the first oil into the elastomer particles.

Comparative Example 3

A developer is prepared in the same manner as in Example 1, except for changing the viscosity $\mu_{VE}$ (25° C.) of the first oil contained in the elastomer particles in Example 1 to 0.1 Pa·s and changing the viscosity $\mu_{VE}$ (25° C.) of the second oil contained in the inorganic particles (small particle diameter external additive) to 0.05 Pa·s.

Comparative Example 4

A developer is prepared in the same manner as in Example 1, except for changing the viscosity $\mu_{VE}$ (25° C.) of the first oil contained in the elastomer particles in Example 1 to 0.1 Pa·s.

Method of Evaluation

Viscosity Measurement

First, the first oil and the second oil are respectively extracted. Specifically, since the large number of the elastomer particles are developed in a non-image part, the toner developed at a high image density is collected to extract the oil, and accordingly, the oil derived from the inorganic particles, that is, the second oil is set. The toner in the developing device at that time is collected and the extracted oil is set as the oil derived from the elastomer particles, that is, the first oil. Each viscosity at 25° C. is measured using RS-CPS Plus manufactured by BROOKFIELD.

Evaluation of Actual Devices

The obtained developer is charged in a developing device of DocuCentre-III C7600 manufactured by Fuji Xerox Co., Ltd., the developer is seasoned for a night in an environment of low temperature and low humidity (10° C. and 15% RH), and evaluation tests are executed in the following viewpoints.

Transfer Efficiency

The transfer efficiency are evaluated with the following test.

After 10,000 images having magenta (M) image density of 1% and cyan (C) image density 20% are continuously output, 10×10 cm secondary color patch having an area grayscale rate of Cin 60% is output and developed on the surface of the photoreceptor, and the patch on the photoreceptor before the primary transfer is transferred to tape, and weight (DMA (M)) of the magenta (M) developing toner and weight (DMA (C)) of the cyan (C) developing toner are measured. The same images are output and secondarily transferred to a sheet, weight (TMA (M+C)) of the toner which is secondarily transferred to a sheet is measured from a difference between the weight of the sheet before fixation and weight of the sheet after the toner is removed. The transfer efficiency (TE) is calculated from the following expression.

$$TE = TMA(M+C)/(DMA(M)+DMA(C)) \times 100(\%)$$

Evaluation criteria are as follows.

G1: 95%≤TE

G2: 90%≤TE<95%

G3: 80%≤TE<90%

G4: TE<80%

Color Unevenness

After 10,000 images having magenta (M) image density of 1% and cyan (C) image density 20% are continuously output, 10×10 cm secondary color patch having a both area grayscale rate of Cin 60% is output, 50 points of the hues in the patch are measured using X-rite 938 (manufactured by X-Rite, Inc.), and a deviation from a target hue (ΔEave) is evaluated. Evaluation criteria are as follows.

G1: ΔEave<1.0

G2: 1.0≤ΔEave<2

G3: 2≤ΔEave<3

G4: 3≤ΔEave

Color Stripe

The number of color stripes (grits) with the C color on 10,000th image is counted. Evaluation criteria are as follows.

G1: less than 50

G2: equal to or more than 50 and less than 100

G3: equal to or more than 100 and less than 200

G4: equal to or more than 200

TABLE 1

| | | Elastomer particles | | | | | Inorganic particles | | | | Toner particles | | | |
|---|---|---|---|---|---|---|---|---|---|---|---|---|---|---|
| | | First oil | | | | Particle | Second oil | | | | Particle | Combination | | |
| | | Presence/ absence | Viscosity $\mu_{VE}$ | Type | Molecular weight | diameter $D50_{VE}$ (μm) | Presence/ absence | Viscosity $\mu_{VA}$ | Type | Molecular weight | diameter $D50_{VT}$ (μm) | $\mu_{VA}/\mu_{VE}$ | $D50_{VE}/D50_{VT}$ | Type of oil |
| Ex. | 1 | Presence | 0.05 | PDMS | 3500 | 5.1 | Presence | 0.1 | PDMS | 6000 | 4.0 | 2.0 | 1.28 | Same type |
| | 2 | Presence | 0.05 | PDMS | 3500 | 5.1 | Presence | 0.1 | PDMS | 6000 | 6.2 | 2.0 | 0.82 | Same type |

TABLE 1-continued

| | | Elastomer particles | | | | | Inorganic particles | | | | Toner particles | | | |
|---|---|---|---|---|---|---|---|---|---|---|---|---|---|---|
| | | First oil | | | | Particle | Second oil | | | | Particle | | | |
| | | Presence/ absence | Viscosity $\mu_{VE}$ | Type | Molecular weight | diameter $D50_{VE}$ (μm) | Presence/ absence | Viscosity $\mu_{VA}$ | Type | Molecular weight | diameter $D50_{VT}$ (μm) | Combination $\mu_{VA}/\mu_{VE}$ | $D50_{VE}/D50_{VT}$ | Type of oil |
| | 3 | Presence | 0.05 | PDMS | 3500 | 4.5 | Presence | 0.1 | PDMS | 6000 | 6.2 | 2.0 | 0.73 | Same type |
| | 4 | Presence | 0.05 | PDMS | 3500 | 7 | Presence | 0.1 | PDMS | 6000 | 4.0 | 2.0 | 1.75 | Same type |
| | 5 | Presence | 0.05 | PDMS | 3500 | 8.5 | Presence | 0.1 | PDMS | 6000 | 4.0 | 2.0 | 2.13 | Same type |
| | 6 | Presence | 0.05 | PhMS | 3600 | 5.1 | Presence | 0.1 | PDMS | 6000 | 4.0 | 2.0 | 1.28 | Different type |
| | 7 | Presence | 0.05 | PDMS-AN | 3300 | 5.1 | Presence | 0.1 | PDMS | 6000 | 4.0 | 2.0 | 1.28 | Different type |
| | 8 | Presence | 0.03 | PDMS | 2500 | 5.1 | Presence | 0.1 | PDMS | 6000 | 4.0 | 3.3 | 1.28 | Same type |
| | 9 | Presence | 0.1 | PDMS | 6000 | 5.1 | Presence | 0.3 | PDMS | 10000 | 4.0 | 3.0 | 1.28 | Same type |
| | 10 | Presence | 0.05 | PDMS | 3500 | 5.1 | Presence | 0.3 | PDMS | 10000 | 4.0 | 6.0 | 1.28 | Same type |
| | 11 | Presence | 0.1 | PDMS | 6000 | 5.1 | Presence | 0.5 | PDMS | 11200 | 4.0 | 5.0 | 1.28 | Same type |
| | 12 | Presence | 0.1 | PDMS | 6000 | 5.1 | Presence | 1 | PDMS | 25000 | 4.0 | 10.0 | 1.28 | Same type |
| | 13 | Presence | 0.03 | PDMS | 2500 | 5.1 | Presence | 0.05 | PhMS | 3600 | 4.0 | 1.7 | 1.28 | Different type |
| Com. | 1 | Presence | 0.05 | PDMS | 3500 | 5.1 | Absence | — | — | — | 4.0 | — | 1.28 | — |
| Ex. | 2 | Absence | — | — | — | 5.1 | Presence | 0.1 | PDMS | 6000 | 4.0 | — | 1.28 | — |
| | 3 | Presence | 0.1 | PDMS | 6000 | 5.1 | Presence | 0.05 | PDMS | 3500 | 4.0 | 0.5 | 1.28 | Same type |
| | 4 | Presence | 0.1 | PDMS | 6000 | 5.1 | Presence | 0.1 | PDMS | 6000 | 4.0 | 1.0 | 1.28 | Same type |

TABLE 2

| | | Results of evaluation | | |
|---|---|---|---|---|
| | | Transfer properties | | |
| | | Transfer efficiency | Color unevenness | Color stripe |
| Example | 1 | G1 | G1 | G1 |
| | 2 | G1 | G2 | G1 |
| | 3 | G2 | G2 | G1 |
| | 4 | G2 | G2 | G2 |
| | 5 | G2 | G2 | G3 |
| | 6 | G1 | G2 | G1 |
| | 7 | G2 | G3 | G1 |
| | 8 | G2 | G2 | G1 |
| | 9 | G2 | G2 | G3 |
| | 10 | G1 | G2 | G3 |
| | 11 | G2 | G2 | G3 |
| | 12 | G3 | G3 | G3 |
| | 13 | G3 | G2 | G1 |
| Comparative example | 1 | G1 | G4 | G1 |
| | 2 | G4 | G3 | G1 |
| | 3 | G4 | G3 | G3 |
| | 4 | G3 | G1 | G4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles;

elastomer particles which are externally added to the toner particles and contain a first oil; and inorganic particles which are externally added to the toner particles and contain a second oil having a viscosity higher than a viscosity of the first oil at 25° C.

2. The electrostatic charge image developing toner according to claim 1, wherein a volume average particle diameter ($D50_{VE}$) of the elastomer particles and a volume average particle diameter ($D50_{VT}$) of the toner particles have a relationship of the following expression:

$$0.8 \leq D50_{VE}/D50_{VT} \leq 2.$$

3. The electrostatic charge image developing toner according to claim 1, wherein the first oil and the second oil are oils in which 90 mol % or more of monomers as raw materials are the same and weight-average molecular weights are different.

4. The electrostatic charge image developing toner according to claim 1, wherein the elastomer particles have a specific surface area of 0.1 $m^2/g$ to 25 $m^2/g$.

5. The electrostatic charge image developing toner according to claim 1, wherein the first oil and the second oil each are a silicone oil.

6. The electrostatic charge image developing toner according to claim 1, wherein the first oil and the second oil each have a melting point being lower than 20° C.

7. The electrostatic charge image developing toner according to claim 1, wherein the first oil has a viscosity of 0.01 Pa·s to 0.5 Pa·s and the second oil has a viscosity of 0.03 Pa·s to 1 Pa·s at 25° C.

8. The electrostatic charge image developing toner according to claim 1, wherein a total content of the first oil is from 0.01 mg to 100 mg with respect to 1 g of the toner and a total content of the second oil is from 0.1 mg to 20 mg with respect to 1 g of the toner.

9. The electrostatic charge image developing toner according to claim 1, wherein a content of the elastomer particles is from 0.05 parts by weight to 5 parts by weight with respect to 100 parts by weight of the toner particles, and an amount of the inorganic particles externally added is from 0.01% by weight to 5% by weight with respect to the toner particles.

10. An electrostatic charge image developer comprising:

the electrostatic charge image developing toner according to claim 1.

11. A toner cartridge which is detachable from an image forming apparatus, comprising the electrostatic charge image developing toner according to claim 1.

* * * * *